US005562498A

United States Patent [19]

Brandenburg et al.

[11] Patent Number: 5,562,498

[45] Date of Patent: Oct. 8, 1996

[54] FLEXIBLE CAPACITOR FILTER

[75] Inventors: Scott D. Brandenburg; William S. Murphy; David A. King, all of Kokomo, Ind.

[73] Assignee: Delco Electronics Corp., Kokomo, Ind.

[21] Appl. No.: 361,081

[22] Filed: Dec. 21, 1994

[51] Int. Cl.[6] ..... H01R 13/66

[52] U.S. Cl. ..... 439/620; 29/25.42

[58] Field of Search ..... 439/620, 44, 67; 29/25.42

[56] References Cited

U.S. PATENT DOCUMENTS

| | | | |
|---|---|---|---|
| 4,894,015 | 1/1990 | Stockero et al. | 439/67 |
| 5,157,583 | 10/1992 | Clelland | 29/25.42 |
| 5,242,318 | 9/1993 | Plass | 439/620 |
| 5,286,221 | 2/1994 | Fencl et al. | 439/620 |
| 5,327,326 | 7/1994 | Komoto et al. | 439/44 |

*Primary Examiner*—Neil Abrams
*Assistant Examiner*—Eugene G. Byrd
*Attorney, Agent, or Firm*—Mark A. Navarre

[57] ABSTRACT

A flexible capacitor is provided which is suitable for use in conjunction with a magnetic core for forming a CLC or pi filter, such as the type used for electrical connectors in the engine control hardware for an automobile. The flexible capacitor is generally composed of a flexible substrate having a surface on which interleaved conductor layers are supported. The interleaved conductor layers include at least two conductor layers, a first of which is composed of a plurality of islands of electrically conductive material which are electrically isolated from each other, while a second layer is composed of an electrically conductive material. A dielectric layer is disposed intermediate each adjacent pair of conductor layers so as to form a capacitive structure. The first conductor layer serves as the signal capacitor plate, while the second conductor layer serves as the ground capacitor plate. The islands of the first conductive layer are preferably arranged in at least two arrays which are spaced apart on the flexible substrate. The flexible capacitor overlays, and preferably wraps around, at least a portion of a magnetic core member, such that the core member forms an inductive element between capacitive elements of the pi filter.

19 Claims, 5 Drawing Sheets

FLEXIBLE CAPACITOR FILTER

The present invention generally relates to capacitor filters. More particularly, this invention relates to a flexible capacitor filter which is particularly suitable for use with multi-pin electrical connectors that require signal filtering for the purpose of shielding electromagnetic interference (EMI).

BACKGROUND OF THE INVENTION

Filters for shielding electrical connectors from electromagnetic interference (EMI) are known in the art. Various filter configurations have been utilized for this purpose, including those composed of only a capacitor (C filters) and those which further include inductive and resistive elements (LC, CLC and CLCR filters). Generally, filters which are equipped with an inductor between a pair of capacitors (CLC or pi filters) offer the most effective shielding from EMI.

In the automotive industry, capacitor filters have been used to provide EMI shielding for electrical connectors, particularly those connectors used for engine control circuitry. Prior art filters which have been employed for this purpose have generally consisted of surface mounted ceramic chip capacitors which are mounted on a polyimide substrate. For optimal filtration in which a pi filter is used, each pin of the connector must be equipped with two chip capacitors, necessitating four capacitor solder joints. For a 160 pin connector of a type used in engine control, the above structure requires the use of 320 chip capacitors, necessitating 640 solder joints. Consequently, such prior art pi filters are complicated and costly to manufacture, and their reliability is dependent on the reliability of a large number of capacitors and their solder connections. Scrappage also tends to be higher as a result of the number of solder joints required with this type of filter structure.

Accordingly, it would be desirable to provide a filter for electrical connectors whose structure and manufacture is less complicated than that of filters composed of soldered chip capacitors. Such a filter would preferably offer design flexibility to allow the filter to be configured as a C, LC, CLC or CLCR filter, so as to be readily configurable to allow its capacitance to be tailored to filter certain frequencies, and also structured to promote the ease with which the filter is assembled with a connector.

SUMMARY OF THE INVENTION

It is an object of this invention to provide a capacitor which is configured to have a flexible laminar structure.

It is a further object of this invention that such a laminar structure provide a capacitor array composed of a number of discrete capacitive elements supported on a flexible substrate.

It is another object of this invention that such a laminar structure be suitable for forming a filter for shielding an electrical connector from EMI.

It is still a further object of this invention that such a laminar structure be particularly suitable for forming LC and CLC (pi) filters, in which the flexible laminar structure overlays a magnetic core that forms an inductive element for the filter.

In accordance with a preferred embodiment of this invention, these and other objects and advantages are accomplished as follows.

According to the present invention, there is provided a flexible capacitor which is suitable for forming a filter for shielding an electrical connector from EMI. The flexible capacitor is particularly suitable for forming LC and CLC (pi) filters, in which the flexible capacitor overlays a magnetic core that forms the inductive element of the filter. Apertures formed in the filter structure allow the conductors of an electrical connector to pass through the filter, allowing the flexible capacitor and the magnetic core to provide capacitive and inductive shielding, respectively, for the conductors of the connector.

The flexible capacitor of this invention is generally composed of a flexible substrate having a surface on which interleaved conductor layers are supported. The interleaved conductor layers include at least two conductor layers, a first of which may be composed of a plurality of islands of electrically conductive material which are electrically isolated from each other, while a second layer is composed of a unitary layer of electrically conductive material.

The first conductor layer serves as the signal capacitor plate for the filter, while the second conductor layer serves as the ground capacitor plate. A dielectric layer is disposed intermediate each adjacent pair of conductor layers so as to provide electrical insulation therebetween, and thereby create capacitive structures corresponding to each of the islands of the first conductive layer.

For the purpose of forming a pi filter, the islands of the first conductive layer are arranged in at least two arrays which are spaced apart on the flexible substrate. In addition, the flexible capacitor is used in conjunction with a core member formed from a suitable high resistance magnetic material, such as ferrite. The flexible capacitor overlays, and preferably wraps around, at least a portion of the core member, such that the core member forms an inductive element between the capacitive structures of the pi filter. In this configuration, a first of the arrays of the first conductive layer is positioned adjacent a first surface of the core member, and a second of the arrays is positioned adjacent a second surface of the core member.

Finally, pins of an electrical connector are received in apertures present in the flexible capacitor and the core member, such that each pin is electrically interconnected with an island of the each of the first and second arrays of the first conductor layer, but is electrically isolated from the second (ground) conductor layer.

As configured above for a pi filter, the flexible capacitor of this invention completely avoids the practice of soldering individual chip capacitors on a substrate. Instead, the capacitive elements are provided within a laminar structure which can serve as a capacitor filter, or which can be wrapped around a magnetic core member for the purpose of forming an LC or CLC filter. Moreover, the flexible capacitor can be readily manufactured to have any number of interleaved conductor layers so as to allow for tailoring of the capacitance of the filter. The flexible capacitor may also be manufactured to be of any size and have any number of islands in each of the first conductive layers, so as to be adaptable to various connector configurations. Finally, because the former requirement to individually solder a large number of chip capacitors on a substrate has been completely eliminated, the flexible capacitor of this invention provides for a significantly more reliable capacitive structure.

Other objects and advantages of this invention will be better appreciated from the following detailed description.

BRIEF DESCRIPTION OF THE DRAWINGS

The above and other advantages of this invention will become more apparent from the following description when taken in conjunction with the accompanying drawings, in which.

DETAILED DESCRIPTION OF THE INVENTION

A flexible capacitor is provided which forms an array of capacitive elements that are supported on a flexible substrate. The flexible capacitor is particularly suitable for use in conjunction with a magnetic core for forming an LC or CLC (pi) filter which is adapted for use with electrical connectors, such as the type used in the engine control hardware of automobiles. While the present invention will be described with particular reference to the use of the flexible capacitor as a component of a pi filter, those skilled in the art will recognize that the teachings of this invention are generally applicable to capacitor structures, for filter applications or otherwise, and also alternatively for use as a component of a C or LC filter.

Figure 1:
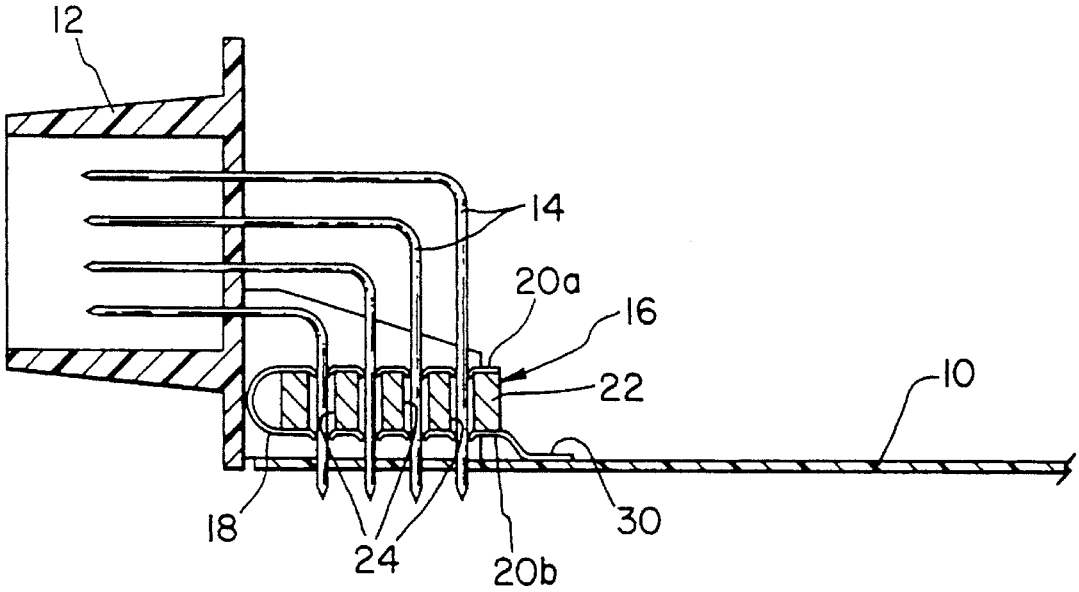
FIG. 1 is a cross-sectional view of an electrical connector equipped with a pi filter configured in accordance with a preferred embodiment of this invention.

Referring to FIG. 1, a circuit board 10 is shown to which an electrical connector header 12 is coupled. The circuit board 10 and connector header 12 can be of any suitable types and configurations known in the art. As shown, a number of pins 14 extend between the circuit board 10 and the connector header 12 for interconnecting electronic circuitry on the circuit board 10 to an external system, such as to a vehicle electrical harness or to diagnostic test equipment. As shown, the pins 14 extend through an EMI filter 16 which is configured in accordance with the present invention. As illustrated, the filter 16 is a pi or CLC filter, though other filter configurations could be employed if preferred. For example, the flexible substrate itself could form the connection between the circuit board and the connector, eliminating the connection between the pins and circuit board.

As a pi filter, the filter 16 is composed of at least one capacitive element in a first capacitor bank 20*a*, an inductive core 22, and at least one capacitive element in a second capacitor bank 20*b*. As illustrated, the capacitive elements of the first and second capacitor banks 20*a* and 20*b* are each formed by an array of capacitive elements, though a single larger capacitive element could be used in place of each of the illustrated arrays. A suitable material for the core 22 is a ferrite block of a type known in the art, though it is foreseeable that other high-resistance magnetic materials could also be used for this purpose.

In accordance with this invention, the capacitor banks 20*a* and 20*b* are formed as a part of a flexible capacitor array 18 which partially envelopes the core 22, such that the capacitor array 18 has a "U" shape. The capacitor banks 20*a* and 20*b* are formed at separate regions of the capacitor array 18 so as to properly position their arrays of capacitive elements relative to the core 22 to form the pi filter 16. The capacitor array 18 includes a low impedance ground region 30 which can be soldered or otherwise electrically interconnected to the circuit board 10 in order to ground the capacitive elements of the capacitor banks 20*a* and 20*b* to the circuit board 10.

Figure 2:
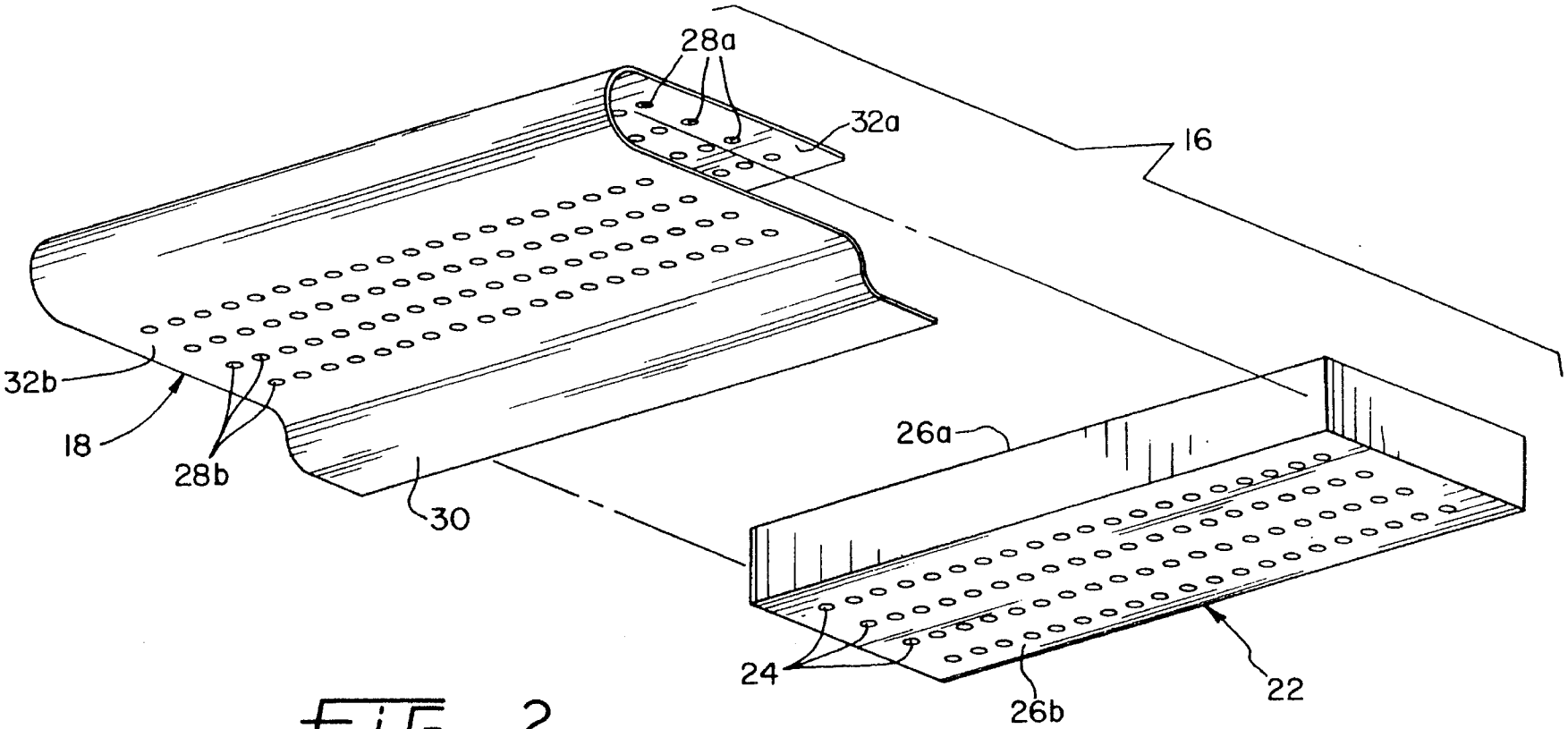
FIG. 2 is an exploded view of the pi filter of FIG. 1, illustrating a flexible capacitor array in accordance with a preferred aspect of this invention.

An exploded view of the filter 16 is shown in FIG. 2. The U-shaped configuration of the capacitor array 18 forms an upper flange 32*a* which contacts an upper surface 26*a* of the core 22, and a lower flange 32*b* which contacts a lower surface 26*b* of the core 22. The upper and lower flanges 32*a* and 32*b* each have arrays of apertures 28*a* and 28*b*, respectively, while the core 22 has complementary apertures 24 which extend through the entire thickness of the core 22. When assembled, the core 22 is nested between the flanges 32*a* and 32*b* so as to align each of the apertures 24 of the core 22 with a corresponding pair of apertures 28*a* and 28*b* in the capacitor array 18. As such, each of the pins 14 of the connector header 12 are able to extend through the filter 16 via the apertures 28*a*, 28*b* and 24, as represented in FIG. 1.

Figure 3:
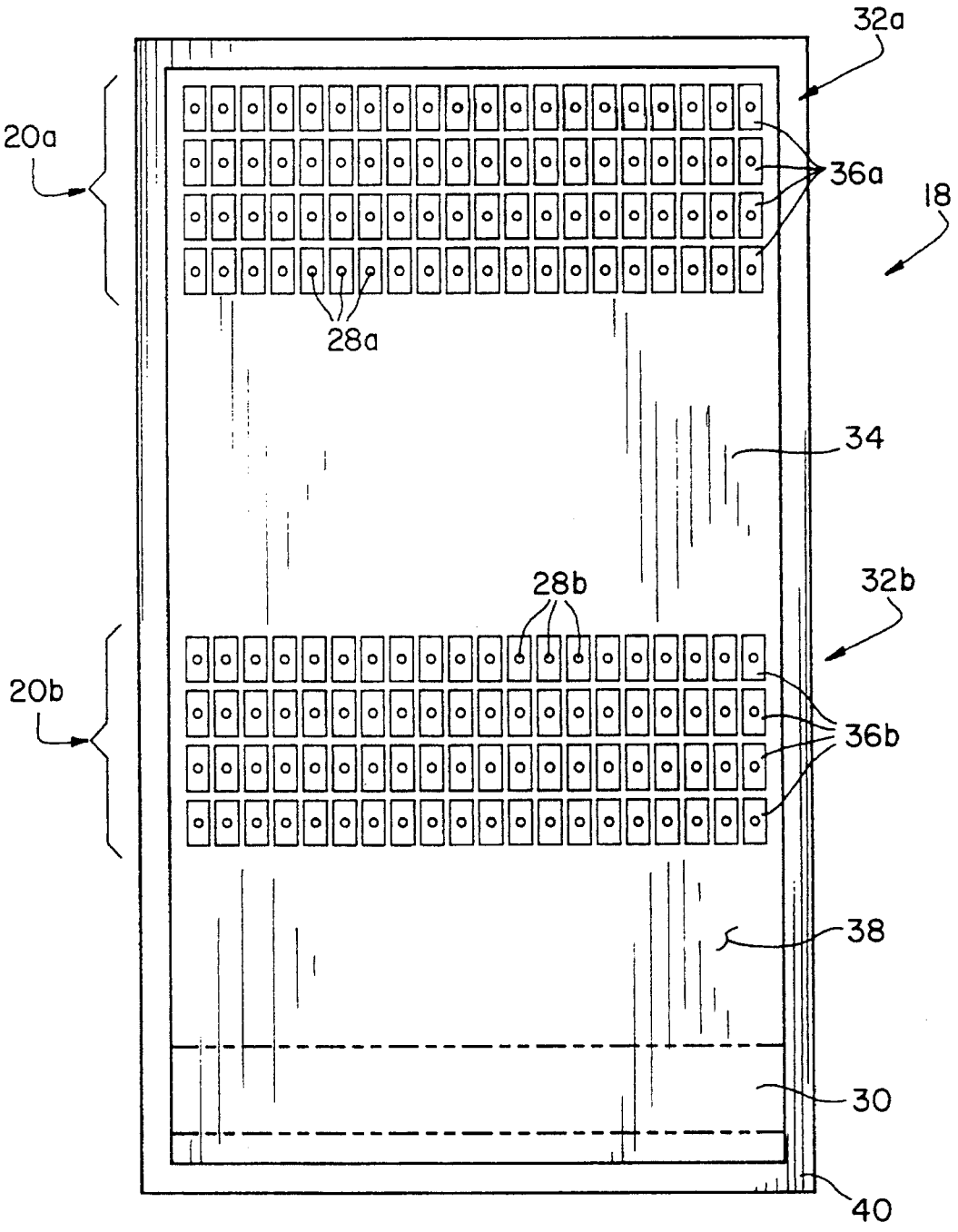
FIG. 3 is a plan view of the flexible capacitor array of FIG. 2.
Figure 4:
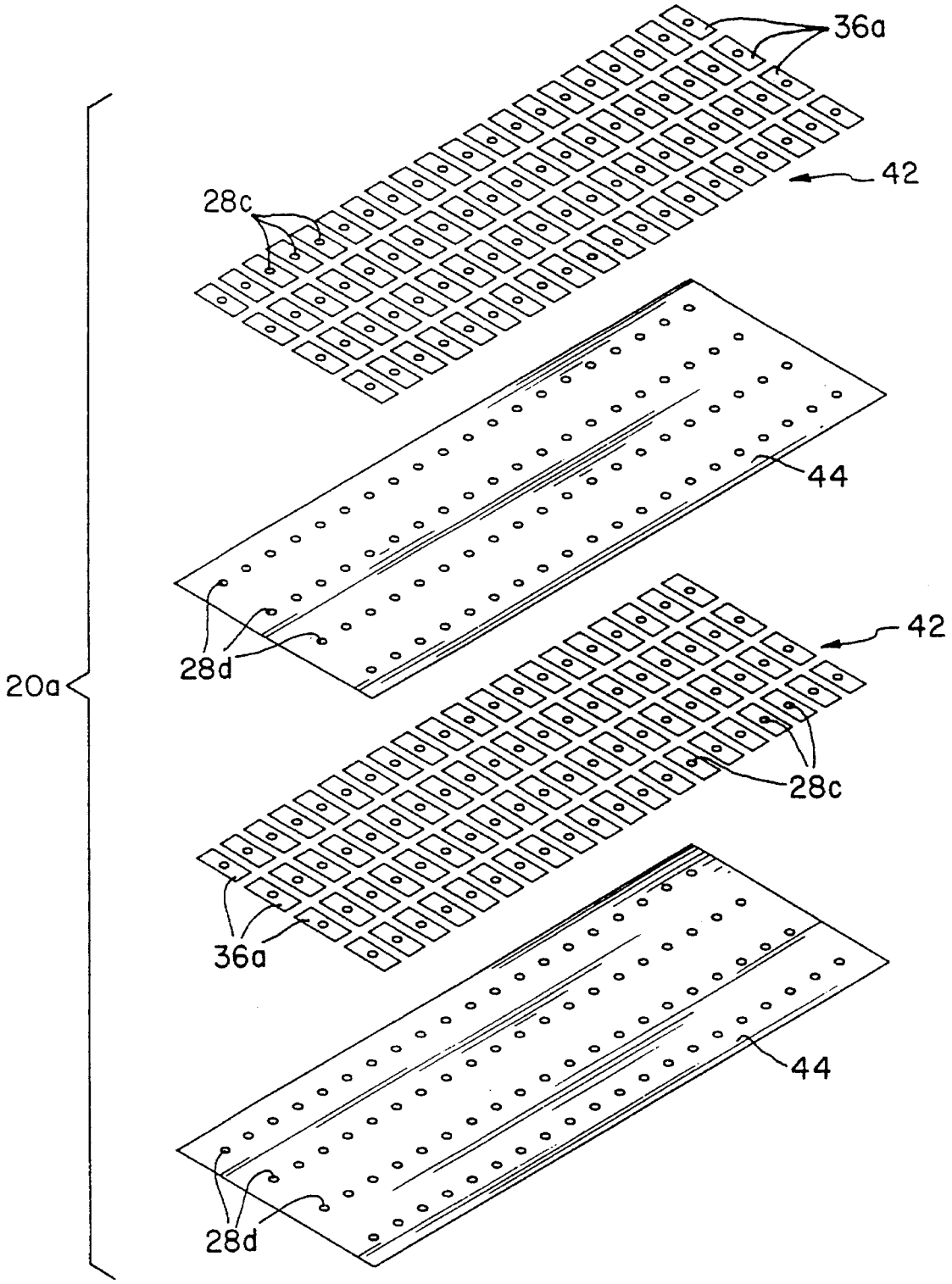
FIG. 4 is an exploded view of the conductor layers of the flexible capacitor array of FIG. 3.
Figure 5:
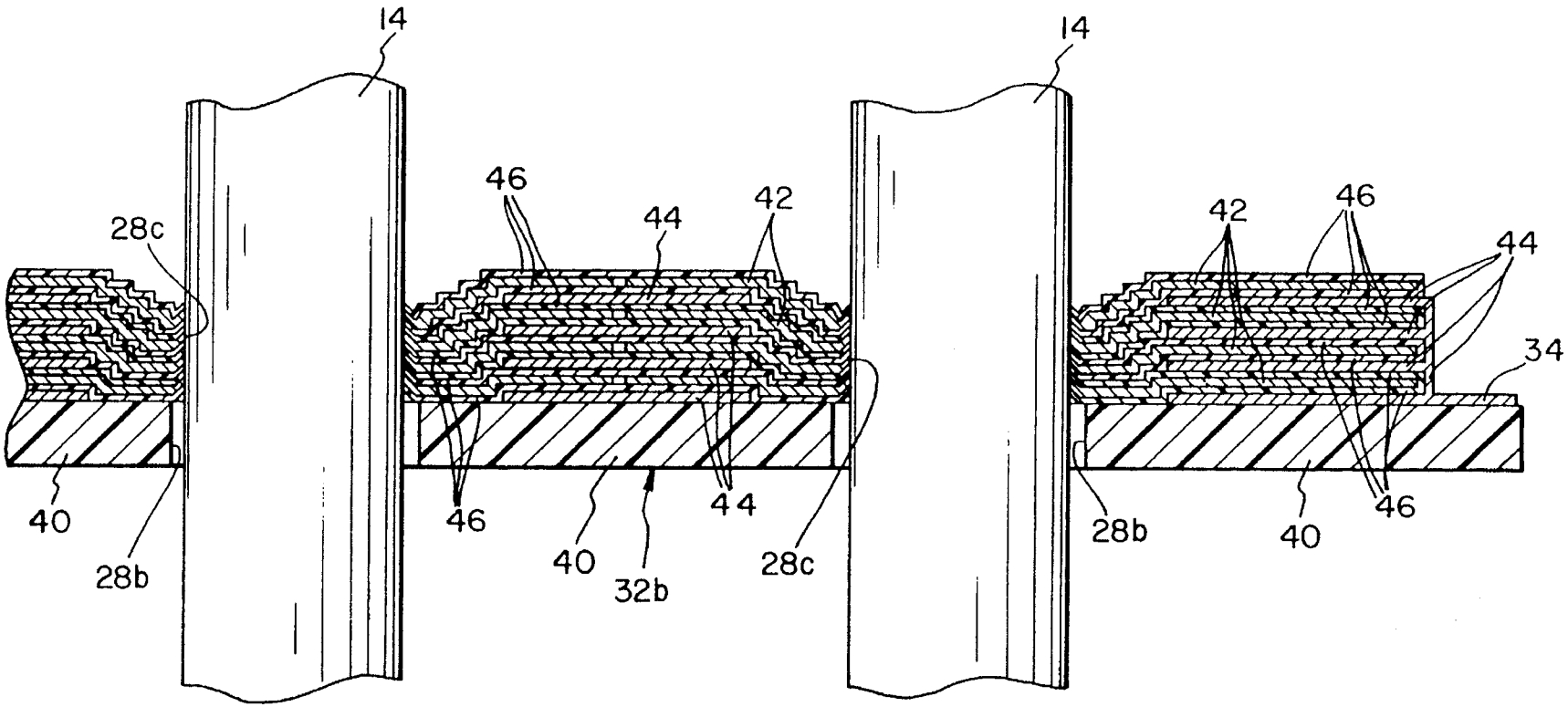
FIG. 5 is a detailed cross-sectional view illustrating the engagement of the connector pins with the flexible capacitor array.

The construction of the flexible capacitor array 18 of this invention is illustrated in greater detail in FIGS. 3 through 5. FIG. 3 is a plan view of the interior surface of the capacitor array 18. A dielectric layer 46 (FIG. 5) which serves to electrically insulate the capacitor banks 20*a* and 20*b* from the core 22 has been omitted to allow illustration of the construction of the capacitor array 18 and the relative positions of the capacitor banks 20*a* and 20*b* on the capacitor array 18. The capacitor banks 20*a* and 20*b* are supported on a flexible polyimide substrate 40, though it is foreseeable that other materials could be used to form the substrate 40. The apertures 28*a* and 28*b* through the flanges 32*a* and 32*b* are shown as passing through discrete capacitor islands 36*a* and 36*b* of the capacitor banks 20*a* and 20*b*, respectively. As shown, the islands 36*a* and 36*b* within each capacitor bank 20*a* and 20*b* are physically, and therefore electrically, isolated from each other.

A first ground plane 34 separates the islands 36*a* within the first capacitor bank 20*a* from the islands 36*b* of the second capacitor bank 20*b*, while a second ground plane 38 separates the capacitor islands 36*b* from the ground region 30 which serves as the low impedance connection for the capacitor array 18. Preferably, the ground planes 34 and 38 extend around the entire perimeter of the capacitor banks 20*a* and 20*b*, so as to enhance the EMI filtering capability of the filter 16.

FIG. 4 is an exploded view of the first capacitor bank 20*a*. The discrete capacitor islands 36*a* which are visible on the capacitor array 18 in FIG. 3, are shown in FIGS. 4 as collectively forming an upper signal capacitor plate 42 of the capacitor array 18. Each island 36*a* is formed from an electrically conductive material, such as copper or a copper alloy. An aperture 28*c*, corresponding to one of the apertures 28*a* formed in the upper flange 32*a* of the capacitor array 18, is formed in each of the islands 36*a*. Additional signal capacitor plates 42 are provided as necessary to achieve the capacitance required for the filter 16.

Each signal capacitor plate 42 is capacitively coupled with a ground capacitor plate 44 which is electrically connected to the ground planes 34 and 38. Each ground capacitor plate 44 is a unitary member also formed from a suitable conductive material, such as copper or a copper alloy. An array of apertures 28*d* is formed in each of the ground capacitor plates 44, with each aperture 28*d* being appropriately located so as to be aligned with one of the apertures 28*a* formed in the upper flange 32*a* and one of the apertures 28*c* formed in the signal capacitor plates 42. Again, dielectric layers 46 (FIG. 5) which insulate the capacitor plates 42 and 44 from each other are omitted in FIG. 4 for clarity. As is conventional, each dielectric layer 46 establishes discrete capacitive elements therebetween, corresponding to the placement of the capacitor islands 36*a* of the signal capacitor plates 42.

The dielectric layer 46 can be a thin layer of any suitable material which exhibits a proper degree of flexibility and has a sufficiently high dielectric constant, such as a ceramic-filled polytetrafluoroethylene (PTFE) films. Other materials could be used, including PTFE films without a ceramic filler. Such films can be used in thicknesses of as little as about 0.5 mils (about 13 micrometers), and have a dielectric constant of about 10 at about 1 megahertz.

The laminar structure described above is more fully illustrated in FIG. 5, which is a cross-sectional view of the lower flange 32*b* of the filter 16 of FIG. 1. The core 22 is omitted for clarity. FIG. 5 shows the interleaved layers of the signal and ground capacitor plates 42 and 44 supported on the substrate 40, with pins 14 passing through the apertures 28*b* formed in the capacitor array 18 and the apertures 28*c* formed in the signal capacitor plate 42. Importantly, the apertures 28*d* formed in the ground capacitor plates 44 are larger than those apertures 28*c* formed in the signal capacitor plates 42, such that the ground capacitor plates 44 are electrically insulated from the pins 14, as shown. The ground capacitor plates 44 are grounded to the circuit board 10 via the ground planes 34 and 38 and the low impedance region 30.

In contrast, the apertures 28*c* in the islands 36*b* (as well as the islands 36*a* of the upper flange 32*a*) of the signal capacitor plates 42 are sized so as to create a gastight pressure contact between the signal capacitor plates 42 and the pins 14, in order to assure electrically continuity between the pins 14 and the signal capacitor plates 42. Advantageously, the apertures 28*c* can be accurately sized to achieve a suitable pressure contact, so as to eliminate the requirement for soldering. Alternatively, electrical continuity can be achieved using an electrically conductive adhesive or another suitable technique known in the art. With any of the above approaches, the result is that each island 36*a* and 36*b* of the signal capacitor plates 42 is electrically connected to a input signal transmitted through one of the pins 14.

From the above, it can be seen that each paired layer of signal and ground capacitor plates 42 and 44 can form any number of capacitive elements, corresponding to the number of capacitor islands 36*a* or 36*b* present in the corresponding signal capacitor plate 42. The capacitor array 18 can be manufactured such that the number and size of the capacitor islands 36*a* and 36*b* corresponds to a particular connector configuration for essentially any connector application. As shown in FIG. 1, in conjunction with the core 22 formed by the ferrite block, the capacitive elements form the pi filter 16 for the purpose of shielding the pins 14 from EMI interference.

Those skilled in the art will appreciate that the flexibility of the capacitor array 18 enables the array 18 to be readily handled and adapted for various configurations. In addition to the choice of dielectric materials and thicknesses and the size of the capacitor banks 20*a* and 20*b*, the number of paired signal and ground capacitor plates 42 and 44 can be varied in order to obtain the capacitance values required for proper filtering. In addition, the thicknesses of the signal and ground capacitor plates 42 and 44 can also be varied, such that a single pair of plates 42 and 44 may be suitable for some applications.

In accordance with this invention, a significant advantage of the flexible capacitor array 18 is that it is configured to completely avoid the practice of soldering individual chip capacitors onto a substrate. Instead, capacitive elements are defined by the islands 36*a* and 36*b* and the ground capacitor plate 44 within the laminar structure of the capacitor array 18. Because the former requirement to individually solder a large number of chip capacitors on a substrate is completely eliminated, the reliability of the flexible capacitor array 18 of this invention is significantly enhanced, as well as the reliability of the electrical component in which it serves, such as the pi filter 16 shown here by example.

While described in terms of a pi filter, the flexible capacitor array 18 of this invention could readily be used for other filter configurations, such as straight capacitor filters and LC filters. Furthermore, thin film resistive elements could be formed on the substrate 40 so as to form a CLCR filter. In addition, the flexible capacitor array 18 could be configured to provide one or more capacitors for any of a number of electronic applications. Accordingly, while our invention has been described in terms of a preferred embodiment, it is apparent that other forms could be adopted by one skilled in the art. Therefore, the scope of our invention is to be limited only by the following claims.

The embodiments of the invention in which an exclusive property or privlilege is claimed are defined as follows:

1. A flexible capacitor comprising:

a flexible substrate;

interleaved conductor layers supported by said flexible substrate, said interleaved conductor layers comprising a first conductor layer composed of a plurality of islands of electrically conductive material which are electrically isolated from each other, and a second conductor layer composed of a layer of electrically conductive material;

a dielectric layer intermediate said first and second conductor layers so as to electrically insulate at least a first island of said plurality of islands from said second conductor layer, said first island forming a capacitive structure with said second conductor layer; and a passage through said flexible capacitor formed by coaxially-aligned apertures through said flexible substrate, said first island said second conductor layer and said dielectric layer, said aperture of said first island being smaller than said aperture of said second conductor layer such that a cantilevered portion of said first island projects into said passage so as to form an electrical contact of said flexible capacitor.

2. A flexible capacitor as recited in claim 1 wherein said interleaved conductor layers comprise a plurality of said first conductor layer and a plurality of said second conductor layer.

3. A flexible capacitor as recited in claim 1 wherein said plurality of islands of said first conductive layer are arranged in at least two arrays spaced apart on said flexible substrate.

4. A flexible capacitor as recited in claim 1 further comprising means for grounding said second conductor layer.

5. A flexible capacitor as recited in claim 1 further comprising a core member formed from a magnetic material, at least a portion of said flexible substrate overlaying at least a portion of said core member such that said core member forms an inductive element adjacent said interleaved conductor layers.

6. A flexible capacitor as recited in claim 5 further comprising an opening through said core member so as to be coaxially-aligned with said passage through said flexible capacitor.

7. A flexible capacitor as recited in claim 6 further comprising a pin received in said passage and said opening, said pin being electrically interconnected with said first island of said plurality of islands through a gas-tight pressure contact with said cantilevered portion of said first island, said pin being electrically isolated from said second conductor layer.

8. A flexible capacitor as recited in claim 5 wherein said flexible substrate is wrapped around said core member such that said flexible substrate is oriented to have a U-shape.

9. A flexible capacitor as recited in claim 8 wherein said passage is a first passage extending through a first portion of said flexible capacitor, said flexible capacitor further comprising:

a second passage through a second portion of said flexible capacitor and formed by coaxially-aligned second apertures through said second conductor layer and a second island of said plurality of islands, said second aperture of said second island being smaller than said second aperture of said second conductor layer such that a cantilevered portion of said second island projects into said second passage so as to form a second electrical contact of said flexible capacitor; and an opening extending through said core member so as to be coaxially-aligned with said first and second passages.

10. A flexible capacitor as recited in claim 9 further comprising a pin received in said first and second passages and said opening, said pin being electrically interconnected with said first and second islands through a gas-tight pressure contact with said cantilevered portions of said first and second islands, said pin being electrically isolated from said second conductor layer.

11. A flexible capacitor filter comprising:

a core member formed from a magnetic material and having an opening therethrough; and a flexible capacitor array overlaying at least a portion of said core member and having a first passage therethrough, said flexible capacitor array comprising:

a flexible substrate having a surface;

interleaved conductor layers supported on said surface of said flexible substrate, said interleaved conductor layers comprising a first conductor layer composed of a plurality of islands of electrically conductive material which are electrically isolated from each other, and a second conductor layer composed of a layer of electrically conductive material, a first island of said plurality of islands and said second conductor layer each having an aperture therethrough that is coaxially-aligned with said opening and said first passage, said aperture of said first island being smaller than said aperture of said second conductor layer such that a cantilevered portion of said first island projects into said first passage so as to form an electrical contact of said flexible capacitor filter;

a dielectric layer intermediate said first and second conductor layers so as to electrically insulate said first island from said second conductor layer, said first island forming a capacitive structure with said second conductor layer, said dielectric layer having a cantilevered portion projecting into said first passage; and means for electrically connecting said second conductor layer to ground.

12. A flexible capacitor filter as recited in claim 11 wherein said interleaved conductor layers comprise a plurality of said first conductor layer and a plurality of said second conductor layer.

13. flexible capacitor filter as recited in claim 11 wherein said flexible capacitor array is wrapped around said core member such that said flexible capacitor array is oriented to have a U-shape, a first portion of said flexible capacitor array overlaying a first surface of said core member and a second portion of said flexible capacitor array overlaying a second surface of said core member.

14. A flexible capacitor filter as recited in claim 13 wherein said first passage is disposed in said first portion of said flexible capacitor array, said flexible capacitor filter further comprising a second passage through said second portion of said flexible capacitor array and coaxially aligned with said opening and said first passage, said second passage being formed by coaxially-aligned second apertures through said second conductor layer and a second island of said plurality of islands, said second aperture of said second island being smaller than said second aperture of said second conductor layer such that a cantilevered portion of said second island projects into said second passage so as to form a second electrical contact of said flexible capacitor filter.

15. A flexible capacitor filter as recited in claim 14 further comprising a pin received in said opening and said first and second passages, said pin being electrically interconnected with said first and second islands through a gas-tight pressure contact with said cantilevered portions of said first and second islands, said pin being electrically isolated from said second conductor layer.

16. An electrical connector comprising:

a core member formed from a magnetic material, said core member having a first surface and a second surface;

a flexible capacitor filter array positioned relative to said core member such that a first portion of said flexible capacitor filter array overlays said first surface of said core member and a second portion of said flexible capacitor filter array overlays said second surface of said core member, said flexible capacitor filter array comprising:

a flexible substrate having a surface;

interleaved conductor layers supported on said surface of said flexible substrate, said interleaved conductor layers comprising a first conductor layer composed of a plurality of islands of electrically conductive material which are electrically isolated from each other, and a second conductor layer composed of a layer of electrically conductive material, said plurality of islands of said first conductive layer being arranged in at least two arrays spaced apart on said flexible substrate, a first array of said at least two arrays being disposed at said first portion of said flexible capacitor filter array and a second array of said at least two arrays being disposed at said second portion of said flexible capacitor filter array, such that said first array of said at least two arrays is adjacent said first surface of said core member and said second array of said at least two arrays is adjacent said second surface of said core member;

a dielectric layer intermediate said first and second conductor layers so as to electrically insulate said first conductor layer from said second conductor layer, such that each of said plurality of islands forms a capacitive element; and means for electrically connecting said second conductor layer to ground;

a plurality of apertures formed in said flexible capacitor filter array and said core member, each of said plurality of apertures passing through said first portion of said flexible capacitor filter array, an island of said first array, said core member, an island of said second array, said second conductive layer and said dielectric layer; and a plurality of pins disposed within said plurality of apertures, each of said plurality of pins is electrically interconnected with at least two islands of said plurality of islands and electrically isolated from said second conductor layer, such that each of said plurality of pins is equipped with a filter formed by an island of said first array, an island of said second array, said dielectric layer, said second conductor layer and said core member.

17. An electrical connector as recited in claim 16 wherein said interleaved conductor layers comprise a plurality of said first conductor layer and a plurality of said second conductor layer.

18. An electrical connector as recited in claim 16 wherein said capacitor filter array is a pi filter.

19. An electrical connector as recited in claim 16 wherein said capacitor filter array is substantially U-shaped.

* * * * *